United States Patent [19]

Jarosz

[11] Patent Number: 4,491,820

[45] Date of Patent: Jan. 1, 1985

[54] DEVICE FOR TERMINATING A FUSIBLE ELEMENT OF AN INTERRUPTING MODULE

[75] Inventor: John M. Jarosz, Skokie, Ill.

[73] Assignee: S&C Electric Company, Chicago, Ill.

[21] Appl. No.: 439,444

[22] Filed: Nov. 5, 1982

[51] Int. Cl.[3] ..... H01H 85/02

[52] U.S. Cl. ..... 337/159; 337/6; 337/252

[58] Field of Search ..... 337/4, 6, 159–166, 337/191, 192, 221, 234, 295, 251, 252, 253; 339/147 R

[56] References Cited

U.S. PATENT DOCUMENTS

| | | | |
|---|---|---|---|
| 3,962,666 | 6/1976 | Knapp | 337/159 |
| 4,146,862 | 3/1979 | Mikulecky | 337/252 |
| 4,161,712 | 7/1979 | Thiel | 337/159 |
| 4,336,521 | 6/1982 | Kozacka et al. | 337/252 |
| 4,342,978 | 8/1982 | Meister | 337/221 |

*Primary Examiner*—William H. Beha, Jr.
*Attorney, Agent, or Firm*—Kirkland & Ellis

[57] ABSTRACT

A terminator device for a fusible element ribbon surrounding a switch in an interrupting module. The device is a conductive collar mountable to a terminal of the switch and an integral finger to which an end of the ribbon is attachable. One or more slotted tabs are also integral with the collar to engage and support fins holding the ribbon in a helix around the switch. The tabs may be deformed to lock the fins in place. The device, which may be a simple stamped part, thus mechanically and electrically mounts the ribbon and supports the fins, as well as electrically interconnecting the ribbon to the switch.

9 Claims, 6 Drawing Figures

DEVICE FOR TERMINATING A FUSIBLE ELEMENT OF AN INTERRUPTING MODULE

BACKGROUND OF THE INVENTION

1. Field of the Invention

The present invention relates to a device for terminating a fusible element of an interrupting module and, more particularly, to a device to which the respective ends of a fusible element of an interrupting module may be electrically and mechanically connected, the device also supporting insulative notched fins about which the fusible element is helically wound, so that the fusible element is connected in electrical shunt with a switch, also contained in the module. The present invention constitutes an improvement of the interrupting modules discloses in commonly assigned co-pending U.S. patent applications, Ser. Nos. 437,925 filed Nov. 1, 1982, now U.S. Pat. No. 4,227,963, issued Jan. 24, 1984, 437,926 filed Nov. 1, 1982, 439,443 filed Nov. 5. 1982, now U.S. Pat. No. 4,434,415, issued Feb. 28, 1984, all in the names of Jarosz and Panas; Ser. No. 188,660, filed Sept. 19, 1980, now U.S. Pat. No. 4,370,531 in the name of Tobin; Ser. No. 179,367, filed Aug. 18, 1980 now abandoned, and Ser. No. 181,603, filed Aug. 27, 1980, now abandoned, both in the names of Jarosz and Panas; Ser. No. 179,366, filed Aug. 18, 1980 now abandoned, in the name of O'Leary; and in commonly assigned U.S. Pat. No. 4,342,978 issued Aug. 3, 1982 in the name of Meister. Further, the device of the present invention may conveniently be used with any fusible usable in a current-limiting fuse, including the fusible elements disclosed in commonly assigned U.S. Pat. No. 4,359,708 issued Nov. 16, 1982, and in commonly assigned U.S. patent application, Ser. No. 437,776 filed Oct. 29, 1982, both in the names of Jarosz and Panas.

2. Discussion of the Prior Art

U.S. Pat. No. 4,342,978 discloses and claims an interrupting module of a current-limiting fuse having a high continuous current rating. The interrupting module comprises a more or less typical current-limiting section, which includes a helically wound fusible element embedded in a compacted mass of a fulgurite-forming medium, such as silica-sand. An outer insulative housing is filled with the sand and surrounds the fusible element. Also within the outer housing is a normally closed switch. The switch includes a pair of contacts which are relatively movable apart along a fixed line of direction for opening thereof. Each end of the fusible element is respectively electrically connected to one of the contacts, which are, in turn, electrically continuous with end terminals carried by the outer housing and by which the module is connected to a high-voltage electrical circuit for protection thereof. The fusible element is maintained in its helical configuration by a pair of notched fins or beams, preferably made of mica, which are positioned diametrically opposite each other along an inner insulative housing also surrounding the switch. Preferably, the inner housing is within and coaxial with the outer housing. Opposed ends of the inner housing are carried by the end terminals.

The impedance of the electrical path through the switch is substantially less than the impedance of the path through the fusible element so that, with the switch normally closed and with the module connected to the protected circuit, the majority of the current in the protected circuit flows through the switch, and not through the fusible element. When a fault current, or other over-current, is detected by sensing facilities, a power cartridge is ignited. Ignition of the power cartridge pressurizes a chamber defined by one of the contacts and by a trailer or piston carried by the other contact, which is movable away from the one contact.

The increase in pressure within the chamber caused by ignition of the power cartridge rapidly moves the trailer and the movable contact carrying it away from the one contact to open the switch, thereby rapidly commutating the fault current in the switch to the fusible element, which interrupts the current in a more or less typical fashion. During movement apart of the contacts, the trailer isolates the widening gap between the contacts and the movable contact from the ignition products of the power cartridge which may be conductive. This isolation inhibits or prevents arcing between the separating contacts. Further, in the event any arc does form between the contacts, the trailer moves through a bore within, and co-acts with, an insulative tube or liner for constricting such arc. The trailer and the tube may, if necessary, be made of an arc-extinguishing material which, when subjected to the high heat of an electrical arc, evolves large quantities of cooling, de-ionizing, and turbulent gases, which along with arc constriction are effective to extinguish any arc which forms.

It has been determined to be desirable to provide a simple, inexpensive device for terminating the fusible element of the interrupting module. Specifically, it has been determined to be desirable to provide a device to which the ends of the fusible element may conveniently and easily be connected, and which electrically connects the fusible element in shunt with the switch and which supports and locks in place the mica fins or beams which helically support the fusible element. The provision of such apparatus is a major object of the present invention.

SUMMARY OF THE INVENTION

With the above and other objects in view, the present invention contemplates a device for terminating a fusible element of an interrupting module. The module includes a switch contained in an elongated insulative housing carrying thereon end terminals electrically connected to the switch. The fusible element is maintained in a helix around the housing by one or more notched fins carried longitudinally of the housing.

The terminating device comprises a conductive collar mountable over each terminal to be carried thereby. A slotted first tab is on each collar, the slots of each tab being engageable with the ends of the fin to support it. A conductive finger is on each collar. The ends of the fusible element are respectively attachable to the fingers to electrically connect the fusible element in shunt with the switch. Preferably, two diametrically opposed fins are used. In this event, each collar includes two slotted tabs, each tab supporting one end of one fin.

The above apparatus performs at least three functions. First, the mounting of each conductive collar over its terminal renders the collar electrically continuous with the terminal and, therefore, with one side of the switch. Second, and accordingly, connecting a respective end of the fusible element to the conductive finger of each collar electrically connects one end of the fusible element to one side of the switch, thus placing the fusible element in electrical shunt with the switch. Third, the slotted tabs on each collar, in engaging the fins, support the fins and prevent them from moving. This prevents the fusible element from assuming other than its desired helical configuration.

In preferred embodiments, each tab extends away from, and each finger is generally parallel to, the housing when its collar is mounted over its terminal. Further, the tab or tabs of each collar are preferably spaced from the finger thereof around the periphery of the collar. In preferred specific embodiments, this spacing is about 90°. Further, in preferred embodiments where two fins are used, the tabs of a given collar are diametrically opposite each other. Where each collar carries two tabs, its finger is, therefore, preferably located midway between the tabs. Each tab may include deformable facilities for locking a fin supported thereby against movement.

DETAILED DESCRIPTION

Figure 1:
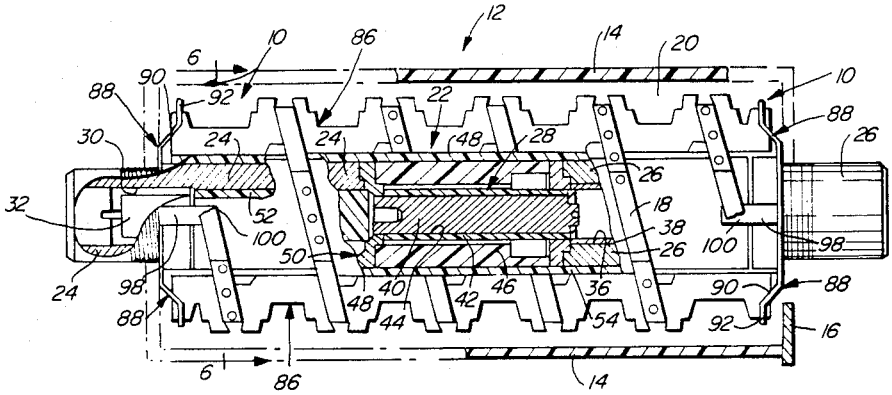
FIG. 1 is a partially sectioned, side elevation of an interrupting module which includes a device according to the present invention.

The present invention relates to a device 10 for use with a current-limiting interrupting module 12. Because the module 12 is more completely described in the above-referenced commonly assigned United States patent and patent applications, it is only generally depicted in the drawing hereof and only generally described herein.

The module 12 includes a generally cylindrical, open-ended outer insulative housing 14, which is closed by end plates 16. The housing 14 and the end plates 16 are only partially shown in FIG. 1. The closed housing 14 surrounds a current-limiting fusible element 18 helically wound around a central axis of the housing 14 and a mass of a particulate, fulgurite-forming medium 20, such as silica sand. The silica sand 20 is in intimate engagement with the fusible element 18. The fusible element 18, which may be a copper, silver or a similar material, and the sand 20 interrupt fault currents or other over-currents therethrough in a current-limiting or energy-limiting manner, according to well-known principles. The fusible element 18 may be similar to those disclosed in commonly assigned U.S. patent applications, Ser. No. 194,712, filed Oct. 6, 1980 and 437,776, filed Oct. 29, 1982, both in the names of Jarosz and Panas.

The housing 14 also surrounds a switch 22 around which the fusible element 18 may be maintained in its helical configuration by a subsequently described support, such as that disclosed in commonly assigned U.S. patent application, Ser. No. 181,603, filed Aug. 27, 1980 now abandoned, in the names of Jarosz and Panas. Although the switch 22 may have numerous constructions in accordance with the previously noted commonly assigned U.S. patent and patent applications, an exemplary embodiment is depicted in FIG. 1. Specifically, the switch 22 includes a first conductive member 24 and a second conductive member 26. The first conductive member 24 serves as a stationary contact of the switch 22 and a left terminal of the module 12, while the second conductive member 26 serves as a stationary terminal of the switch 22 and a right terminal of the module 12. The ends of the fusible element 18 are electrically connected with the conductive members 24 and 26 by the device 10 of the present invention.

The switch 22 also includes a movable contact 28. Normally, the movable contact 28 is electrically continuous with both conductive members 24 and 26 so that a continuous low-resistance electrical path is formed between the members 25 and 26 via the movable contact 28. Because the resistance of this path is lower than the resistance of the fusible element 18, while the switch 22 is closed, as depicted in FIG. 1, the majority of the current flowing through the module 12 is normally shunted by the switch 22 away from the fusible element 18. When the switch 22 opens, as described below, the current formerly flowing through the members 24 and 26 and the movable contact 28 is commutated to the fusible element 18 for interruption.

In specific embodiments, the first conductive member 24 may have a central bore 30. At the left end of the central bore 30, a power cartridge 32, or other pressure-generating device, is located. The second conductive member 26 also contains a central bore 36. This bore 36 may be lined with an insulative sleeve 38, which may, if necessary, be made of an arc-extinguishing material.

The movable contact 28 comprises a cylindrical conductive member 40 surrounded by an insulative sleeve 42, which may, if necessary, be made of an arc-extinguishing material. The movable contact 28 is normally located centrally between the conductive members 24 and 26 and within the bore 44 of an insulative member or liner 46 centrally held between the conductive members 24 and 26. The insulative member 46 may, if necessary, be made of an arc-extinguishing material.

The conductive members 24 and 26 are maintained in an aligned relationship, and the liner 46 is held in place therebetween, by an inner insulative housing 48 which partially surrounds the conductive members 24 and 26 and is mounted thereto in any convenient manner.

With the movable contact 28 occupying the position shown in FIG. 1, the conductive member 40 thereof is electrically interconnected to the conductive member 24 by a conductive diaphragm 50 or other metallic member, which is shearable, tearable or the like. To the left of the diaphragm 50, the conductive member 40 carries an insulative trailer or piston 52, which may be made of an arc-extinguishing material. In the normal position of the movable contact 28 shown in FIG. 1, the trailer 52 normally occupies the central bore 30 of the first conductive member 24.

The right end of the conductive member 40 is normally electrically interconnected to the second conductive member 26 by a diaphragm 54, which may be similar to the diaphragm 50. The interior of the insulative sleeve 38 is sufficiently large to conformally receive the conductive member 40 with its insulative sleeve 42 thereon. Further, the bore 44 of the liner 46 is sufficiently large to conformally receive both the conductive member 40 with the insulative sleeve 42 thereon and the trailer 52.

In the normal condition of the module 12, as shown in FIG. 1 and as previously described, the switch 22 carries all or a majority of the current flowing in a protected high-voltage circuit (not shown) to which the module 12 is connected. This current flows through the conductive members 24 and 26, the diaphragms 50 and 54, and the movable contact 28. Little or no current normally flows through the fusible element 18. Should a fault current or other over-current occur in the protected circuit (not shown) to which the fuse 12 is connected, apparatus (not shown) detects this condition and ignites the power cartridge 32. Ignition of the power cartridge 32 causes it to evolve large qualtities of high-pressure gas which act on the left end of the trailer 52. The force applied to the trailer 52 by the high pressure rapidly moves the trailer 52 and the movable contact 28 (i.e., the conductive member 40 with the insulative sleeve 42 thereon) rightwardly.

Rightward movement of the trailer 52 and of the movable contact 28 severs, rips or tears the diaphragms 50 and 54, thereby breaking the electrical interconnection between the movable contact 28, on the one hand, and both conductive members 24 and 26, on the other hand. Two gaps are thereby opened by the switch 22. The first gap exists between the left end of the conductive member 40, the right end of the first conductive member 24, while the second gap exists between the right end of the conductive member 40 and the left end of the second conductive member 26. Both gaps are insulated. Specifically, the first gap is insulated by the conformal reception of the trailer 52 within the bore 44 of the sleeve 46. The second gap is insulated by the conformal reception of the insulative sleeve 42 within the bore 44 of the insulative member 46. The conformal reception of the trailer 52 by the bore 44 of the insulative member 46 also isolates the movable contact 28 from the ignition products of the power cartridge 32, which may contain electrically conductive arc-promoting materials. If an arc should form between the first conductive member 24 and the conductive member 40, such arc must pass between the trailer 52 and the wall of the bore 44, which constricts the arc. Additionally, if such an arc is likely to form, the trailer 52 and the member 46 may be made of arc-extinguishing materials from which large quantities of cooling, de-ionizing, and turbulent arc-extinguishing gas will be evolved by the heat of the arc. All of these features either prevent formation of an arc between the first conductive member 24 and the movable contact 28 or, should such an arc form, ultimately extinguish it.

The conformal reception of the insulative sleeve 42 within the insulative sleeve 38 serves a similar function relative to preventing formation of an arc between the conductive member 40 and the second conductive member 26 or, should such an arc form, extinguishment thereof.

When the switch 22 opens, the current previously flowing therethrough is commutated to the fusible element 18. The action of the fusible element 18 and of the silica sand 20 ultimately extinguishes this current, as is well known.

As already noted, the present invention relates to a device 10 for terminating the fusible element 18 and for electrically connecting its ends to the conductive members 24 and 26. The apparatus 10 is generally shown in FIG. 1 and is more specifically shown in FIGS. 2–6.

Figure 3:
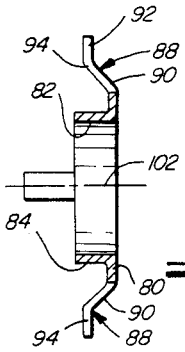
FIG. 3 is a sectional view of FIG. 2 taken along line 3—3 therein.
Figure 4:
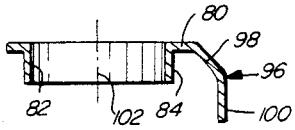
FIG. 4 is a sectional view taken along line 4—4 in FIG. 2.
Figure 5:
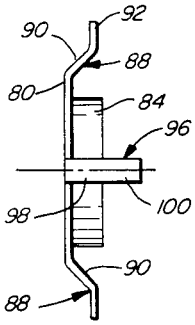
FIG. 5 is a sectional view taken along lines 5—5 in FIG. 2.

The apparatus 10 may be seen to include an electrically conductive collar 80 which may take the general ring shape depicted and which defines a central aperture 82. The diametric size of the aperture 82 is such that one collar 80 may be slipped over each of the conductive members 24 and 26. As best shown in FIGS. 3–5, the aperture 82 may be defined within a flanged lip 84 continuous with the collar 80. The wall of the aperture 82 within the flanged lip 84, the exterior surfaces of the conductive member 24 and 26, or all three of these items may be roughened or otherwise textured to permit a collar 80 to be inserted about and press-fitted onto each conductive member 24 and 26 and held in place thereon. The collar 80 and the lip 84 are preferably made of a conductive metal, such as phosphor bronze.

In FIG. 1, two diametrically opposed notched fins or beams 86 running along the housing 48 maintain the fusible element 18 in its helical configuration. For a more detailed description of these fins or beams 86, which are made of an insulative material, such as mica, see commonly assigned U.S. patent application, Ser. No. 181,603, filed Aug. 27, 1980 now abandoned, in the names of Jarosz and Panas.

Figure 2:
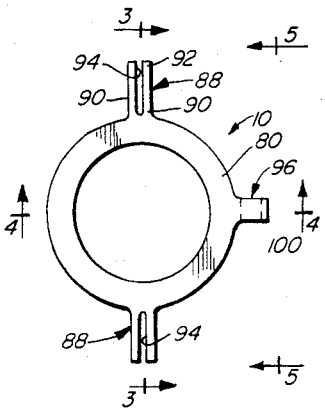
FIG. 2 is a front elevation of the device according to the present invention.
Figure 6:
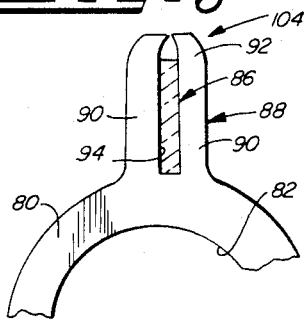
FIG. 6 is a partial sectional view taken generally along line 6—6 in FIG. 1.

Each collar 80 has formed integrally therewith a pair of tabs 88. There may be a different number of tabs 88 corresponding in number to the number of fins 86. Each tab 88 includes a portion 90 which slants away from the collar 80 in the general direction of the flanged lip 84 and a portion 92 which extends away from the portion 90 generally parallel to the surface of the collar 80. As best shown in FIGS. 1, 2, and 6, the tabs 88 include slits or notches 94 on a diameter of the aperture 82. The slits or notches 94 extend from the free ends of the portions 92 to approximately the point where the tab 88 merges with the collar 80. Where two fins 86 are present, it is preferred that the tabs 88 both be located on the same diameter of the aperture 82 so that they are diametrically opposed relative to the collar 80.

Each collar 80 also includes an integral finger 96. As best shown in FIGS. 1, 4, and 5, the finger 96 includes a portion 98 which extends obliquely away from the collar 80 in the general direction in which the flanged lip 84 extends and a portion 100 which is generally parallel to the flanged lip 84 and to a major central axis 102 of the aperture 82. In preferred embodiments, the finger 96 is located midway between the tabs 88, although other relative positions are possible.

The collar 80 with the tabs 88 and the finger 46 may be formed in any convenient fashion, as by stamping or the like.

Referring to FIG. 1, the device 10 of the present invention is used in the following manner. A collar 80 with the tabs 88 and the finger 96 thereon is positioned over the conductive member 24 and the conductive member 26 at opposite ends of the switch 22. This is achieved by positioning the aperture 82 of each collar 80 over its respective conductive member 24 and 26. Such mounting of the collars 80 is achieved so that the portions 90 of the tabs 88 and the portions 98 of the fingers 96 of each collar 80 on the opposite ends of the switch 22 extend toward each other and away from the ends of the conductive members 24 and 26.

As shown in FIG. 1, the slits 94 of each tab 88 engage the end of one fin 86 on opposite sides thereof, and the ends of the fusible ribbon 18 are attached by welding, or a similar operation, to the portions 100 of the fingers 96. In this fashion, the tabs 88 support the fins 86, the fingers 96 provide terminating points for the fusible element 18, and the fingers 96 and the collar 80, along with the flanged lip 84, electrically connect the fusible element 18 in shunt with the switch 22 via their mechanical and electrical engagement with the conductive members 24 and 26.

Referring to FIG. 6, the fins 86 may be further supported and maintained relative to the housing 48 by slightly crimping together the furcations of the tab portions 90 and 92 defined by the slit 94, as shown at 104. Specifically, if the ends of the portions 100 are crimped together as at 104, the fins 86 are prevented from moving out of the slits 94 in a direction generally away from the housing 48 to further stabilize the structure of the interrupting module 12.

As can be seen, therefore, the device 10 comprises a simple, inexpensive, stamped metal part which may be conveniently incorporated into the interrupting module 12 for performance of a plurality of functions therein. Other advantages of the present invention will be obvious to those having skill in the art.

I claim:

1. An apparatus for terminating a fusible element, the fusible element being maintained in a helix around an elongated insulative housing by a fin carried longitudinally on the housing, the housing carrying an electrical terminal on an end thereof, the apparatus comprising:

a conductive collar mountable over the terminal for mechanical and electrical connection thereto;

a slotted first tab on the collar, the slot being engageable with one end of the fin to support the fin; and a conductive finger on the collar, an end of the fusible element being attachable to the finger.

2. A terminating apparatus for terminating a fusible element of an interrupting module, the module including a switch contained in an elongated insulative housing which carries thereon an end terminal electrically connected to the switch, the fusible element being maintained in a helix around the housing by a fin carried longitudinally on the housing, the terminating apparatus comprising:

a conductive collar mountable over the terminal for mechanical and electrical connection thereto;

a slotted first tab on the collar, the slot being engageable with one end of the fin to support the fin; and a conductive finger on the collar, an end of the fusible element being attached to the finger to electrically connect the fusible element in shunt with the switch.

3. An apparatus as in claim 2 or 1, wherein:

the tab extends away from, and the finger is generally parallel to, the housing when the collar is mounted over the terminal.

4. An apparatus as in claim 3, wherein:

the tab and the finger are spaced apart around the periphery of the collar.

5. An apparatus as in claim 4, wherein:

the tab and finger are spaced apart by 90°.

6. An apparatus as in claim 1, which further comprises deformable means on the tab for locking the fin supported thereby against movement after deformation thereof.

7. A pair of the apparatus as in claim 2 or 1, usable in a module having two end terminals containing two notched fins, wherein:

the first tab on each collar is engageable with the opposite ends of one fin, and which further comprises a slotted second tab on each collar, the respective slots thereof being engageable with opposed ends of the other fin, whereby the fins are diametrically opposed relative to the housing.

8. An apparatus as in claim 7, which further comprises:

deformable means on each tab for locking a fin supported thereby against movement after deformation thereof.

9. An apparatus as in claim 8, wherein:

each finger is located midway between the first and second tabs of its collar.

* * * * *

UNITED STATES PATENT AND TRADEMARK OFFICE

CERTIFICATE OF CORRECTION

PATENT NO. : 4,491,820

DATED : January 1, 1985

INVENTOR(S) : John M. Jarosz

It is certified that error appears in the above-identified patent and that said Letters Patent are hereby corrected as shown below:

Col. 1, line 17, "discloses" should be --disclosed--.

Col. 1, line 31, after "fusible" insert --element--.

Col. 3, line 56, "437,776" should be --Serial No. 437,776--.

Col. 4, line 14, "25" should be --24--.

Col. 8, line 4, "attached" should be --attachable--.

Col. 8, line 16, "claim 1" should be --claim 1 or 2--.

Signed and Sealed this

*Second* Day of *July 1985*

[SEAL]

*Attest:*

DONALD J. QUIGG

*Attesting Officer* *Acting Commissioner of Patents and Trademarks*